US007881622B2

(12) United States Patent
Sayama et al.

(10) Patent No.: US 7,881,622 B2
(45) Date of Patent: Feb. 1, 2011

(54) IMAGE FORMING APPARATUS

(75) Inventors: Haruo Sayama, Yamatokoriyama (JP); Yasushi Matsutomo, Nara (JP); Kiwamu Morita, Minamikawachi-gun (JP); Michihiro Yamashita, Nara (JP); Yuriko Kamei, Nara (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 1086 days.

(21) Appl. No.: 11/551,780

(22) Filed: Oct. 23, 2006

(65) Prior Publication Data

US 2007/0092271 A1 Apr. 26, 2007

(30) Foreign Application Priority Data

Oct. 25, 2005 (JP) ..... 2005-309580

(51) Int. Cl.
*G03G 15/00* (2006.01)

(52) U.S. Cl. ..... 399/21; 399/9; 399/16; 399/76; 399/405

(58) Field of Classification Search ..... 399/21, 399/9, 16, 76, 405
See application file for complete search history.

(56) References Cited

U.S. PATENT DOCUMENTS

| | | | | |
|---|---|---|---|---|
| 5,253,082 | A * | 10/1993 | Hayashi et al. | 358/1.9 |
| 6,158,844 | A * | 12/2000 | Murakami et al. | 347/55 |
| 6,449,440 | B1 * | 9/2002 | Sawada | 399/19 |
| 7,092,646 | B2 * | 8/2006 | Schroath et al. | 399/21 |
| 2005/0286912 | A1 * | 12/2005 | Matsuzaki | 399/9 |

FOREIGN PATENT DOCUMENTS

| | | | |
|---|---|---|---|
| JP | 62-196245 | | 8/1987 |
| JP | 01-122856 | A | 5/1989 |
| JP | 09183537 | A * | 7/1997 |
| JP | 10-017175 | A | 1/1998 |
| JP | 10-069136 | A | 3/1998 |
| JP | 10-226136 | | 8/1998 |
| JP | 2000-122361 | | 4/2000 |
| JP | 2001-247235 | | 9/2001 |
| JP | 2001-334736 | | 12/2001 |
| JP | 2005-178241 | | 7/2005 |
| JP | 2005-215621 | A | 8/2005 |

* cited by examiner

*Primary Examiner*—Judy Nguyen
*Assistant Examiner*—Andy L Pham
(74) *Attorney, Agent, or Firm*—Renner, Otto, Boisselle & Sklar, LLP

(57) ABSTRACT

An image forming apparatus includes a feeding portion, an image forming portion, a discharge portion, a paper transport path, a plurality of detection members, and a control portion. The image forming portion forms images on sheets of paper fed from the feeding portion. The path transports paper from the feeding portion to the discharge portion via the image forming portion. The detection members detect transport state of paper at respective locations on the path including the feeding portion, between the feeding and image forming portions, within the image forming portion, between the image forming and discharge portions, and the discharge portion. Upon detection of paper jam at any of the locations, the control portion displays, on an indicator, information identifying a location where the jam has occurred, and the image forming portion where paper is detected by the detection members, as locations of paper to be eliminated from the path.

3 Claims, 9 Drawing Sheets

802

TO THE OPERATOR:

THE THREE PAGES FOLLOWING THIS PAGE ARE MISSED PAGES RESULTING FROM THE PAPER JAM.

PLEASE REARRANGE THE MISSED PAGES IN THE ORIGINAL PAGE ORDER.

FIG.4

| PAPER | PROCESSING STATUS OF PAPER | | |
|---|---|---|---|
| | FIRST SIDE IMAGE FORMING | SECOND SIDE IMAGE FORMING | STATUS |
| SHEET 601 | COMPLETE | COMPLETE | DOUBLE-SIDED IMAGE FORMING ENDED. UNDERGOING DISCHARGE PROCESS. |
| SHEET 602 | COMPLETE | COMPLETE | DOUBLE-SIDED IMAGE FORMING ENDED. UNDERGOING FIXING PROCESS. |
| SHEET 603 | COMPLETE | CURRENTLY PROCESSING | UNDERGOING IMAGE FORMING OF SECOND SIDE |
| SHEET 604 | COMPLETE | INCOMPLETE | PRIOR TO IMAGE FORMING OF SECOND SIDE. WAITING AT REGISTRATION ROLLER. |
| SHEET 605 | COMPLETE | INCOMPLETE | PRIOR TO IMAGE FORMING OF SECOND SIDE. WAITING ON FIRST TRANSPORT PATH. |
| SHEET 606 | COMPLETE | INCOMPLETE | IMAGE FORMING OF FIRST SIDE COMPLETE. WAITING ON THIRD TRANSPORT PATH. |
| SHEET 607 | COMPLETE | INCOMPLETE | IMAGE FORMING OF FIRST SIDE COMPLETE. WAITING ON THIRD TRANSPORT PATH. |
| SHEET 608 | COMPLETE | INCOMPLETE | IMAGE FORMING OF FIRST SIDE COMPLETE. WAITING ON SECOND TRANSPORT PATH. |
| SHEET 609 | INCOMPLETE | INCOMPLETE | PRIOR TO IMAGE FORMING OF FIRST SIDE. WAITING ON FIRST TRANSPORT PATH AFTER BEING FED. |
| SHEET 610 | INCOMPLETE | INCOMPLETE | PRIOR TO IMAGE FORMING OF FIRST SIDE. WAITING AT FEED ROLLER AFTER BEING FED. |

FIG.7

| JAM DETECTION SENSOR | JAMMED PAPER | PAPER TO BE ELIMINATED |
|---|---|---|
| SENSOR 82F | SHEET 601 | SHEETS 601, 602, 603 |
| SENSOR 82E | SHEET 602 | SHEETS 602, 603 |
| SENSOR 82D | SHEET 603 | SHEETS 602, 603 |
| SENSOR 82C | SHEET 604 | SHEETS 604, 602, 603 |
| SENSOR 82J | SHEET 605 | SHEETS 605, 602, 603 |
| SENSOR 82I | SHEET 606 | SHEETS 606, 602, 603 |
| SENSOR 82H | SHEET 607 | SHEETS 607, 602, 603 |
| SENSOR 82G | SHEET 608 | SHEETS 608, 602, 603 |
| SENSOR 82B | SHEET 609 | SHEETS 609, 602, 603 |
| SENSOR 82A | SHEET 610 | SHEETS 610, 602, 603 |

801

TO THE OPERATOR:

DUE TO THE PAPER JAM, PAGES ARE MISSING PRIOR TO THIS PAGE.

ON COMPLETION OF THE PRINT JOB, PLEASE EXTRACT THESE PAGES FROM THE MISSED PAGES AND ARRANGE THE PAGE ORDER.

FIG.8

IMAGE FORMING APPARATUS

CROSS REFERENCE

This Nonprovisional application claims priority under 35 U.S.C. §119(a) on Patent Application No. 2005-309580 filed in Japan on Oct. 25, 2005, the entire contents of which are hereby incorporated by reference.

BACKGROUND OF THE INVENTION

The present invention relates to an image forming apparatus constituting a transport path that transports paper fed from a feeding portion to a discharge portion via an image forming portion, and more particularly to improving the process of removing paper jams that occur on the transport path.

With an image forming apparatus, paper is transported on a transport path from a feeding portion to a discharge portion via an image forming portion, and images are formed by the image forming portion on the transported paper. There are image forming apparatuses that form a relatively long transport path spanning a plurality of internal locations, such as those having a feeding portion with a plurality of feed trays, or those with a transport path for inverting paper that has passed through the image forming portion and transporting the paper again to the image forming portion when forming images on both sides.

Meanwhile, there is a strong demand for speeding up the image forming process in image forming apparatuses. To this end, plural sheets of paper are fed continuously from the feeding portion at short intervals when the image forming process is performed continuously on a large quantity of paper.

With image forming apparatuses that perform fast image forming and have a relatively long transport path, the operation of the apparatus stops with a lot of paper on the transport path if a paper jam occurs in part of the transport path.

Removing all of the paper on the transport path during the jam removal operation makes the jam removal operation troublesome, and leads to resource wastage due to usable paper also being discarded.

In view of this, a conventional image forming apparatus disclosed in JP 2001-334736A detects jams on either of two transport paths from two feeding portions to the image forming portion, and displays on which of the two transport paths a jam has occurred.

However, while it is possible with the above conventional image forming apparatus to identify the location of jams that occur between the feeding portion and the image forming portion, it is not possible to identify the location of jams that occur between the image forming portion and the discharge portion. Also, consideration is not given to the removal of image-formed sheets from the transport path as a result of the jam removal operation.

The operator is thus unable to accurately identify paper that should be removed from between the image forming portion and the discharge portion on the transport path in the jam removal operation, giving rise to the possibility that the image forming process will be restarted with paper remaining that should have been removed or paper being eliminated that need not have been removed. As a result, it may not be possible to properly restart the image forming process or this may lead to resource wastage due to usable paper being discarded.

Also, when image-formed sheets are removed from the transport path as a result of the jam removal operation being performed during an image forming process for forming a plurality of page-numbered images on a plurality of sheets in page order, not all of the pages of images will in the ejected stack of image-formed sheets. The operator thus has to perform the image forming process again in relation to the missing pages after checking the stack of image-formed sheets, and insert the obtained image-formed sheets in a prescribed place in the stack of image-formed sheets initially ejected, creating more work for the operator.

A feature of the present invention is to identify and display paper that should be removed in a jam removal operation, based on the result of detecting the location of jammed paper and other paper on a transport path from a feeding portion to a discharge portion, and thereby ensure that only paper that should be removed is reliably removed.

Another object of the present invention is to perform image forming in relation to an image for facilitating the collation of stacks of image-formed sheets after the jam removal operation, and thereby facilitate the process of collating the stacks performed by the operator.

SUMMARY OF THE INVENTION

The present invention includes a feeding portion, an image forming portion, a discharge portion, a paper transport path, a plurality of detection members, and a control portion. The feeding portion feeds plural sheets of prestored paper, one at a time. The image forming portion forms images on the sheets of paper fed from the feeding portion. The discharge portion collects image-formed sheets on which images have been formed in the image forming portion. The paper transport path transports paper from the feeding portion to the discharge portion via the image forming portion. The detecting members detect the transport state of paper at a plurality of detection locations that include the feeding portion, between the feeding portion and the image forming portion, within the image forming portion, between the image forming portion and the discharge portion, and the discharge portion on the paper transport path. When a paper jam at any of the plurality of detection locations is detected based on the detection results of the plurality of detecting members, the control portion displays, on an indicator, information identifying the detection location at which the jam was detected and the image forming portion in which paper is detected by the detecting members as locations of paper to be eliminated from the paper transport path. The operator is thus notified not only of jammed paper but also of paper that is currently undergoing image forming, as paper to be eliminated from the paper transport path in the jam removal operation.

If the image forming portion is displayed as the location of paper to be eliminated from the paper transport path, the control portion may firstly form in the image forming operation restarted after the jam a first notification image notifying the occurrence of the jam. The location of paper eliminated as a result of a jam in a stack of image-formed sheets is thus clearly identified.

Also, the control portion may include a storage portion for storing information identifying an image to be formed on paper stopped in the image forming portion if the image forming portion is displayed as the location at which paper to be eliminated from the paper transport path has stopped, and may perform the image forming operation in relation to a second notification image notifying that the image which was to be formed on eliminated paper will be formed on paper and in relation to the image identified by the information stored in the storage portion, once the image forming operation in relation to a final image included in the image forming operation restarted after the jam has ended. The image-formed sheets to be inserted in the stack of image-formed sheets in place of the paper eliminated as a result of the jam removal operation are thus clearly identified.

The first or second notification image may include an image notifying which sheets in a stack of image-formed sheets were removed as a result of the jam removal process. The location of paper eliminated as a result of a jam in a stack of image-formed sheets is thus clearly identified.

BRIEF DESCRIPTION OF THE DRAWINGS

FIG. 4 is a diagram illustrating the transport state of paper during double-sided image forming on the transport path of the image forming apparatus.

FIG. 7 is a diagram illustrating the relation between the location of jams that occur during double-sided image forming in the image forming apparatus and paper to be eliminated.

FIG. 8 shows an exemplary first notification image formed by the image forming apparatus.

DETAILED DESCRIPTION OF THE INVENTION

An image forming apparatus according to a preferred embodiment of the present invention is described in detail below with reference to the drawings.

Figure 1:
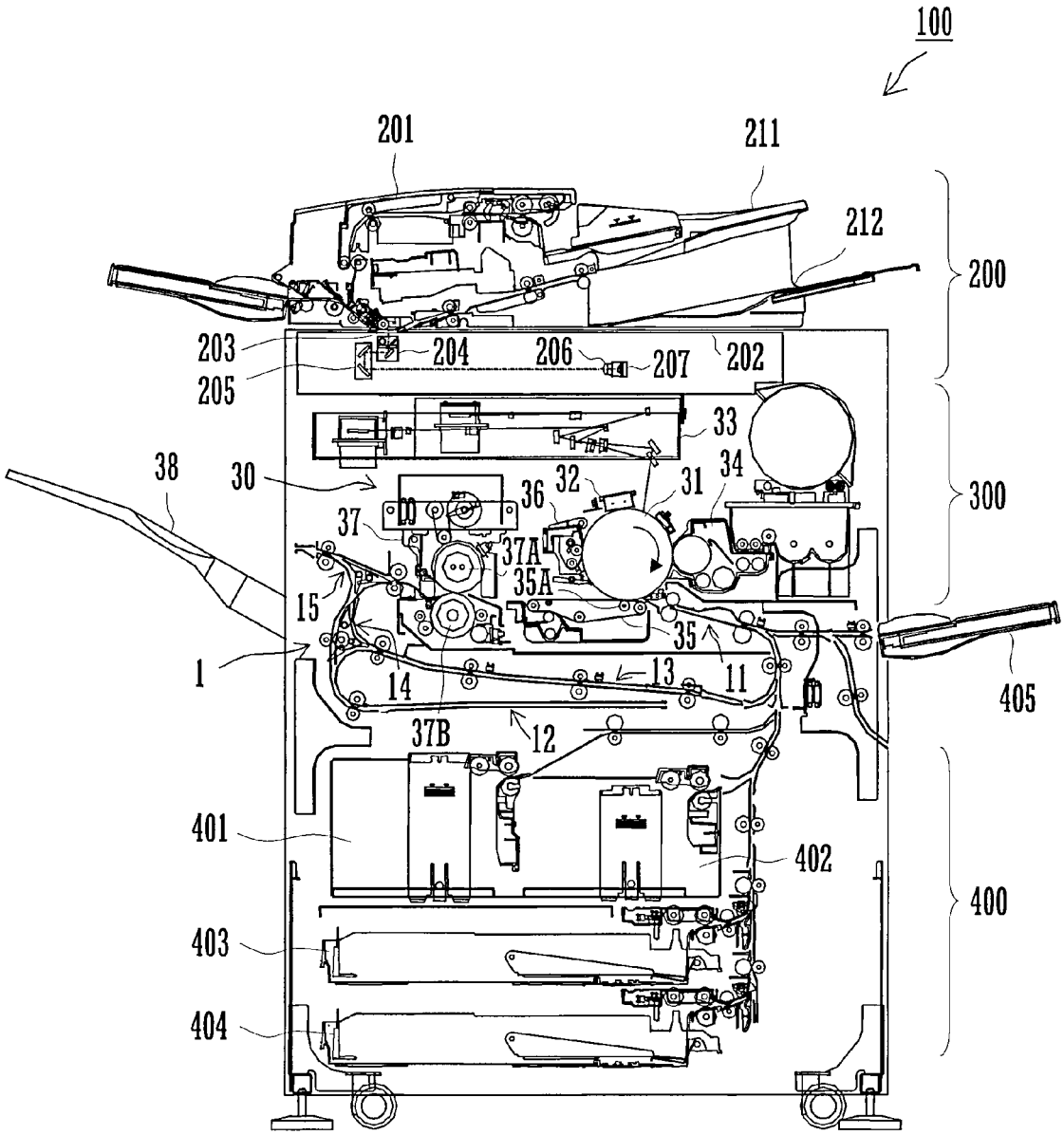
FIG. 1 is a front cross-sectional schematic view showing the configuration of an image forming apparatus according to an embodiment of the present invention.

FIG. 1 is a front cross-sectional schematic view showing the configuration of an image forming apparatus according to an embodiment of the present invention. An image forming apparatus 100 of the present invention is configured from an image reading unit 200, an image forming unit 300, and a feeding unit 400.

The image reading unit 200 includes an ADF (automatic document feeder) 201, a first platen 202, a second platen 203, a first mirror base 204, a second mirror base 205, a lens 206, and a CCD (Charge Coupled Device) 207.

The ADF 201 transports a document, one sheet at a time, from a document tray 211 to an ejection tray 212 via the second platen 203. The ADF 201 is pivotable on a fulcrum at the back end thereof, so as to cover the upper surface of the first platen 202 in an openable/closable manner. The document can be manually set on the first platen 202 by pivoting the ADF 201 so that front end moves upwards to expose the upper surface of the first platen 202. The first platen 202 and the second platen 203 are both constructed using hard glass plate.

The first mirror base 204 and the second mirror base 205 are horizontally movable below the first platen 202 and the second platen 203. The second mirror base 205 moves at half the speed of the first mirror base 204. The first mirror base 204 is equipped with a light source and a first mirror. The second mirror base 205 is equipped with a second mirror and a third mirror.

When reading the image of a document transported by the ADF 201, the first mirror base 204 is stationary below the second platen 203. The light of the light source is irradiated towards the image surface of the document that passes over the second platen 203, and light reflected by the image surface of the document is reflected towards the second mirror base 205 by the first mirror.

When reading the image of a document set on the first platen 202, the first mirror base 204 and the second mirror base 205 move horizontally below the first platen 202. The light of the light source is irradiated towards the image surface of the document set on the first platen 202, and light reflected by the image surface of the document is reflected towards the second mirror base 205 by the first mirror.

Irrespective of whether the ADF 201 is used or not, light reflected by the image surface of the document is incident on the CCD 207 with a constant optical path length via the lens 206 as a result of the second and third mirrors.

The CCD 207 outputs an electrical signal that depends on the intensity of the light reflected by the image surface of the document. This electrical signal is input to the image forming unit 300 as image data.

The image forming unit 300 includes a photosensitive drum 31, a charging device 32, an exposure apparatus 33, a developing apparatus 34, a transfer belt 35, a cleaner 36, and a fixing apparatus 37 that constitute an image forming portion 30.

The photosensitive drum 31 has a photosensitive layer formed on the surface thereof, and rotates in the direction of the arrow. The charging device 32 evenly charges the surface of the photosensitive drum 31 to a prescribed potential. The charging device 32 may employ either of a non-contact method using a charger or a contact method using a roller or a brush.

The exposure apparatus 33 irradiates light that is based on the image data onto the surface of the photosensitive drum 31. An electrostatic latent image is formed on the surface of the photosensitive drum 31 as a result of photoconduction in the photosensitive layer. The exposure apparatus 33 reflects laser light modulated based on the image data with a polygon mirror, and scans the reflected laser light in an axial direction of the photosensitive drum 31. An exposure apparatus having light-emitting devices such as ELs or LEDs disposed in an array can also be used in place of the exposure apparatus 33.

The developing apparatus 34 supplies toner to the surface of the photosensitive drum 31, and visualizes the electrostatic latent image into a toner image.

The transfer belt 35 is strung in a loop around a plurality of rollers below the photosensitive drum 31, and has a resistance of around $1\times10^{9}$ O·cm to $1\times10^{13}$ O·cm. A transfer roller 35A that contacts the photosensitive drum 31 under pressure with the transfer belt 35 sandwiched therebetween is provided inside the migration path of the looped transfer belt 35A. A prescribed transfer voltage is applied to the transfer roller 35A, and the toner image supported by the photosensitive drum 31 is transferred to paper passing between the transfer belt 35 and the photosensitive drum 31.

The cleaner 36 eliminates toner remaining on the surface of the photosensitive drum 31 after the transfer of the toner image to the paper.

The fixing apparatus 37 includes a heating roller 37A and a pressure roller 37B. The heating roller 37A is heated using an internal heater to a temperature capable of melting the toner. The pressure roller 37B contacts the heating roller 37A at a prescribed pressure. The fixing apparatus 37 fixes the toner image strongly to the paper by heating and pressurizing paper that passes between the heating roller 37A and the pressure roller 37B. Paper that has passed through the fixing apparatus 37 is ejected into a discharge tray 38 mounted on one side of the image forming apparatus 100. The discharge tray 38 equates the discharge portion of the present invention.

The feeding unit 400 is the feeding portion of the present invention, and includes feed cassettes 401 to 404 and a manual feed tray 405. Plural sheets of same size paper are stored in each of the feed cassettes 401 to 404. Paper of a size and quality infrequently used is set in the manual feed tray 405.

The feeding unit 400 feeds paper, one sheet at a time, from any of the feed cassettes 401 to 404 or the manual feed tray 405. Paper fed from the feeding unit 400 is transported to the image forming portion 30 via a paper transport path 1 described below.

Figure 2:
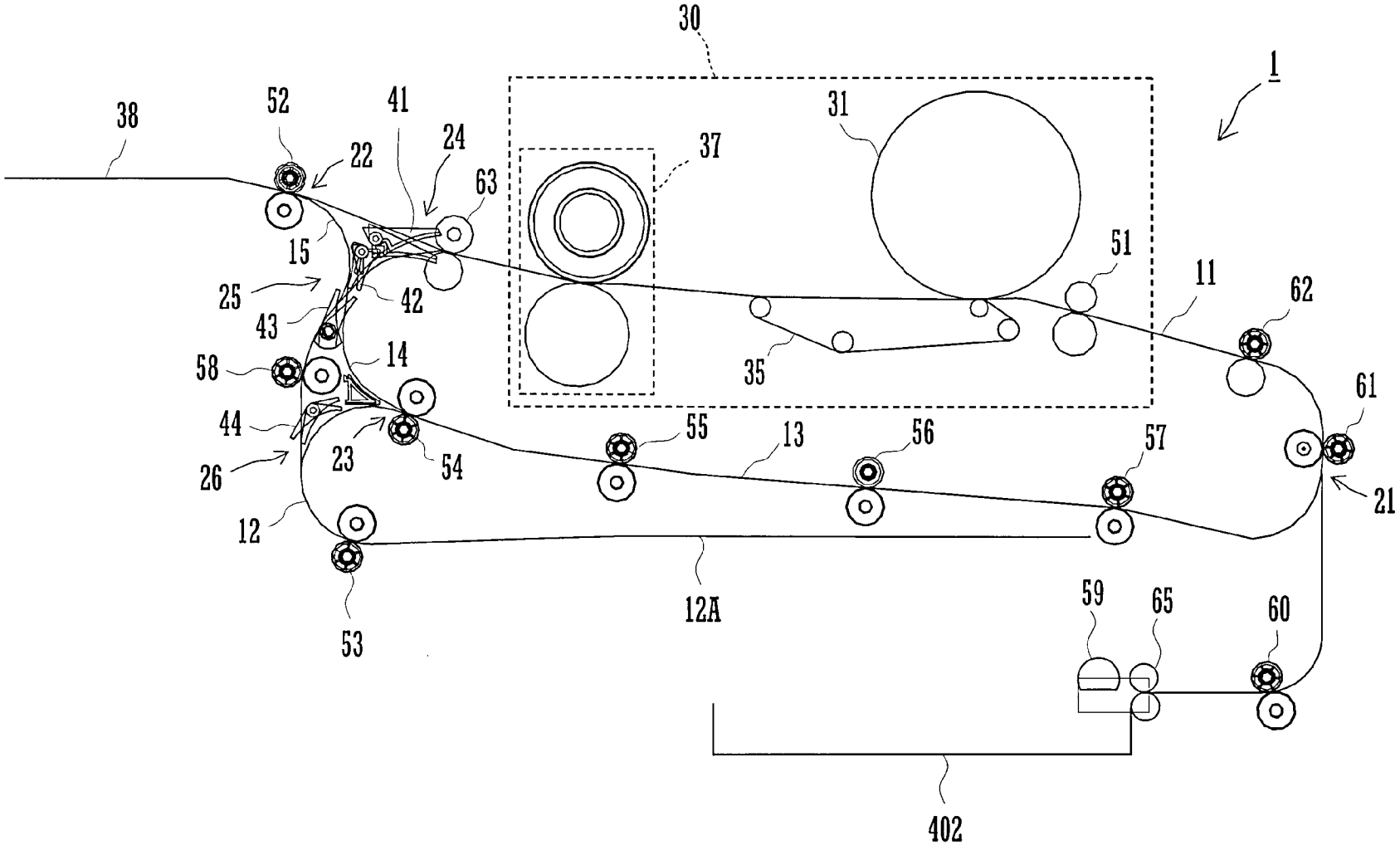
FIG. 2 is a diagram showing the configuration of a paper transport path in the image forming apparatus.

FIG. 2 shows the configuration of the paper transport path 1 in the image forming apparatus 100. The paper transport path 1 is constructed inside the image forming unit 300. The paper transport path 1 includes a first transport path 11, a second transport path 12, a third transport path 13, a fourth transport path 14, and a fifth transport path 15.

The first transport path 11 reaches from the feeding unit 400 to the discharge tray 38 via a first merging portion 21, the image forming portion 30, a first separation portion 24 and a second merging portion 22 in this order. A supply roller 59, a feed roller 65, transport rollers 61 to 63, a transfer belt 35, a registration roller 51, and a discharge roller 52 are disposed on the first transport path 11. Rotation is supplied to the supply roller 59, the feed roller 65, the transport rollers 61 to 63, the transfer belt 35, the registration roller 51 and the discharge roller 52 from a plurality of motors (not shown).

The second transport path 12 reaches from the first separation portion 24 disposed between the image forming portion 30 and the discharge tray 38 on the first transport path 11 to a first switchback portion 12A via a lower-positioned second separation portion 25 and third separation portion 26 in this order. The first switchback portion 12A is substantially parallel with an interval of the first transport path 11 that passes through the image forming portion 30, and transports paper back and forth. Switchback rollers 53 and 58 are disposed on the second transport path 12. Rotation is selectively supplied to the switchback rollers 53 and 58 in the normal or reverse direction from a motor (not shown) via a clutch (not shown).

The third transport path 13 reaches from the third separation portion 26 to the first merging portion 21 disposed between the feeding unit 400 and the image forming portion 30 on the first transport path 11 via a third merging portion 23. Transport rollers 54 to 57 are disposed on the third transport path 13. Rotation is selectively supplied to the transport rollers 54 to 57 in the normal or reverse direction from a third motor (not shown) via a second clutch (not shown).

The fourth transport path 14 connects the second separation portion 25 and the third merging portion 23. The fifth transport path 15 connects from the second separation portion 25 to the second merging portion 22.

The first switchback portion 12A is disposed below the interval in the first transport path 11 that passes though the substantially horizontally disposed image forming portion 30 so as to be substantially parallel with this interval. The third transport path 13 is constructed between the interval in the first transport path 11 that passes though the image forming portion 30 and the first switchback portion 12A.

A separation claw 41 is disposed in the first separation portion 24. The separation claw 41 swings between a position shown by the solid line in FIG. 2 and a position shown by the two-dot chain line as a result of the operation of a first solenoid (not shown), and switches the transport direction of paper in the first separation portion 24 to either the first transport path 11 or the second transport path 12.

A separation claw 42 and a separation claw 43 are disposed in the second separation portion 25. The separation claw 42 is at a position shown by the solid line in FIG. 2 when an external force is not at work, and guides paper transported up from the second transport path 12 or the fourth transport path 14 to the fifth transport path 15. The separation claw 42 regulates entry to the second transport path 12 of paper transported up from the second transport path 12 or the third transport path 13.

The separation claw 43 swings between a position shown by the solid line in FIG. 2 and a position shown by the two-dot chain line as a result of the operation of a second solenoid (not shown), and opens either between the fourth transport path 14 and the fifth transport path 15 or between the second transport path 12 and the fifth transport path 15 in the second separation portion 25.

Note that the separation claw 42 swings to a position shown by the broken line in FIG. 2 as a result of coming into contact with paper transported down on the second transport path 12 from the first separation portion 24.

A separation claw 44 is disposed in the third separation portion 26. Paper that has been reversed front-to-back in the first switchback portion 12A is not ejected into the discharge tray 38 from the second transport path 12 via the fifth transport path 15. For this reason, the switchback roller 58 rotates only one way, and the separation claw 44 is biased by an elastic member in the position shown by the solid line in FIG. 2. This elastic member causes just enough elastic force to work on the separation claw 44 to allow the separation claw 44 to swing easily to a position shown by the broken line in FIG. 2 as a result of paper moving from the first transport path 11 towards the first switchback portion 12A via the second transport path 12. As a result, the separation claw 44 selectively opens between the second transport path 12 and the third transport path 13 or the second transport path 12 in the third separation portion 26.

Figure 3:
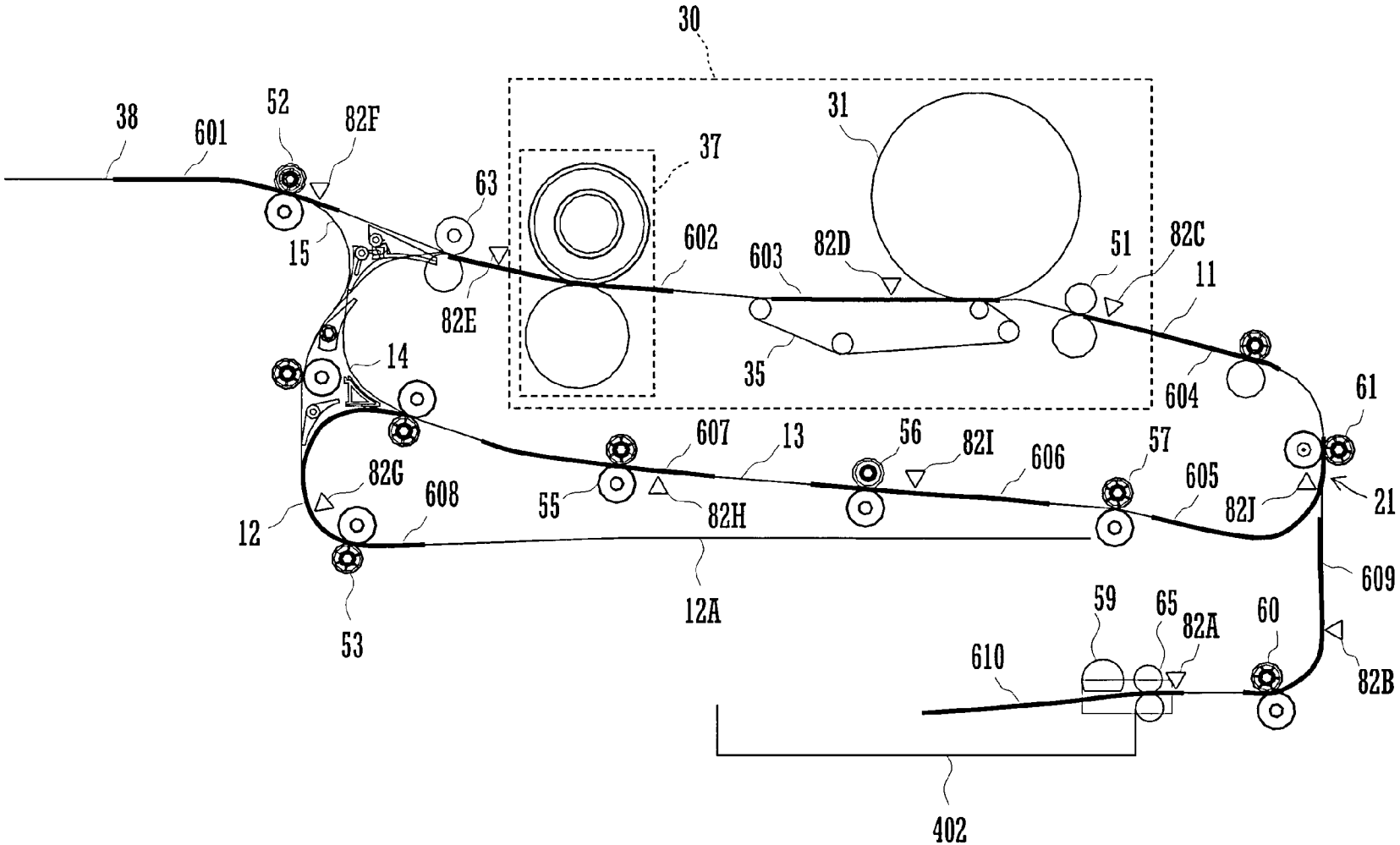
FIG. 3 is a diagram showing the placement location of sensors on the transport path of the image forming apparatus and the transport state of paper during double-sided image forming.

FIG. 3 shows the placement location of sensors 82A to 82J on the paper transport path 1 of the image forming apparatus 100 and the transport state of paper during double-sided image forming. On the first transport path 11, the sensor 82A is placed downstream of the feed roller 65, the sensor 82B is placed between the transport rollers 60 and 61, and the sensor 82C is placed upstream of the registration roller 51. Also, the sensor 82D is placed on the transfer belt 64, the sensor 82E is placed downstream of the fixing unit 37 and the sensor 82F is placed upstream of the discharge roller 52 on the first transport path 11.

On the second transport path 12, the sensor 82G is placed between the switchback rollers 53 and 58. On the third transport path 13, the sensor 82H is placed between the transport rollers 55 and 56, the sensor 82I is placed between the transport rollers 56 and 57, and the sensor 82J is placed between the transport rollers 57 and 61.

The sensors 82A to 82J, which correspond to a plurality of detection members of the invention, detect the presence of transported paper in their respective placement locations. The transport state of paper in each placement location can be detected according to detection signals output from the sensors 82A to 82J during the image forming process, allowing the occurrence of a paper jam and the location of the jam to be detected.

With the image forming apparatus 100, a maximum of ten sheets 601 to 610 are present on the paper transport path 1 during the double-sided image forming process for forming images on both sides of the paper, as shown in FIG. 4 by way of example.

The sheet 601 is in the process of being discharged by the discharge roller 52 after having images formed on both sides. The second side of the sheet 602 is undergoing a fixing process in the fixing unit 37. The second side of the sheet 603 is undergoing a transfer process between the photosensitive drum 31 and the transfer belt 64. The sheet 604 is waiting at the point of contact with the registration roller 51 for image forming to be performed on the second side after completion of image forming on the first side.

The sheets 605 to 607 are waiting on the third transport path 13 after completion of image forming on the first side. The sheet 608 has been reversed back-to-front and is waiting on the second transport path 12 after the completion of image forming on the first side.

The sheets 609 and 610 have yet to undergo image forming on the first side, and are waiting for completion of the image forming process on the second side of all of the previously transported sheets after being fed from the feed tray 402.

Figure 5:
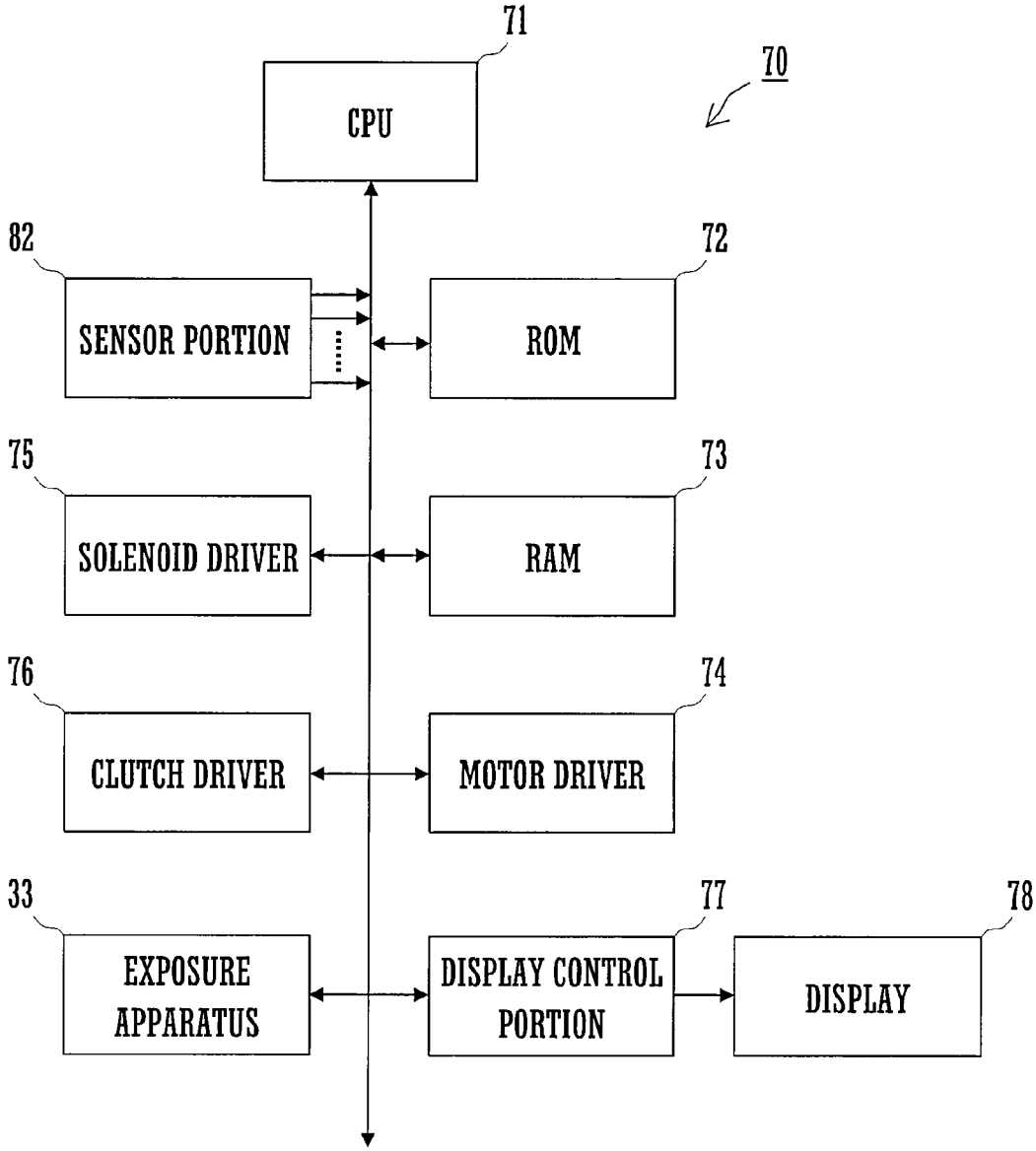
FIG. 5 is a block diagram showing the configuration of a control portion of the image forming apparatus.

FIG. 5 shows the configuration of a control portion 70 of the image forming apparatus 100. In the control portion 70 of the image forming apparatus 100, a motor driver 74, a solenoid driver 75, a clutch driver 76, a display control portion 77 and a sensor portion 82 are connected to a CPU 71 that includes a ROM 72 and a RAM 73, together with devices such as the exposure apparatus 33 of the image forming portion 30.

The sensor portion 82 includes the plurality of sensors 82A to 82J placed on the paper transport path 1. The sensors 82A to 82J respectively detect paper at different locations on the paper transport path 1, and input detection signals to the CPU 71.

The CPU 71 refers to the detection signals input from the sensor portion 82 and outputs drive data to the motor driver 74, the solenoid driver 75, the clutch driver 76 and devices such as the exposure apparatus 33, in accordance with programs written in advance into the ROM 72.

A plurality of motors that supply rotation to the transport rollers 61 to 63 and the like are connected to the motor driver 74. The motor driver 74 drives the motors based on the drive data input from the CPU 71.

A plurality of solenoids that separately operate each of the separation claws 41, 43 and 44 are connected to the solenoid driver 75. The solenoid driver 75 drives the solenoids based on the drive data input from the CPU 71.

A plurality of clutches for selectively transmitting the rotation of the motors to the registration roller 51, the switchback rollers 53 and 58, and the like are connected to the clutch driver 76. The clutch driver 76 drives the clutches based on the drive data input from the CPU 71.

A display 78 provided on an operation panel (not shown) is connected to the display control portion 77. The display control portion 77 displays messages and the like on the display 78 based on display data supplied from the CPU 71. The display 78 is the indicator of the present invention.

The CPU 71 outputs drive data that depends on the image data to the exposure apparatus 33. The exposure apparatus 33 drives a semiconductor laser using the drive data input from the CPU 71, and irradiates laser light that is based on the image data onto the surface of the photosensitive drum 31.

If any of the sensors 82A to 82J does not detect paper for more than a prescribed time period that is obtained by dividing the transport interval between sheets by the transport speed, the CPU 71 judges that a paper jam has occurred at the placement location of a sensor adjacent on the upstream side of that sensor, based on the detection signals input from the sensor portion 82 during image forming.

Also, if any of the sensors 82A to 82J continues to detect paper for more than a prescribed time period that is obtained by dividing the length of each sheet in the transport direction by the transport speed, the CPU 71 judges that a paper jam has occurred at the placement location of that sensor, based on the detection signals input from the sensor portion 82 during image forming.

When a jam occurs, the CPU 71 outputs display data to the display control portion 77 indicating that a jam has occurred and the location of paper to be eliminated.

Figure 6:
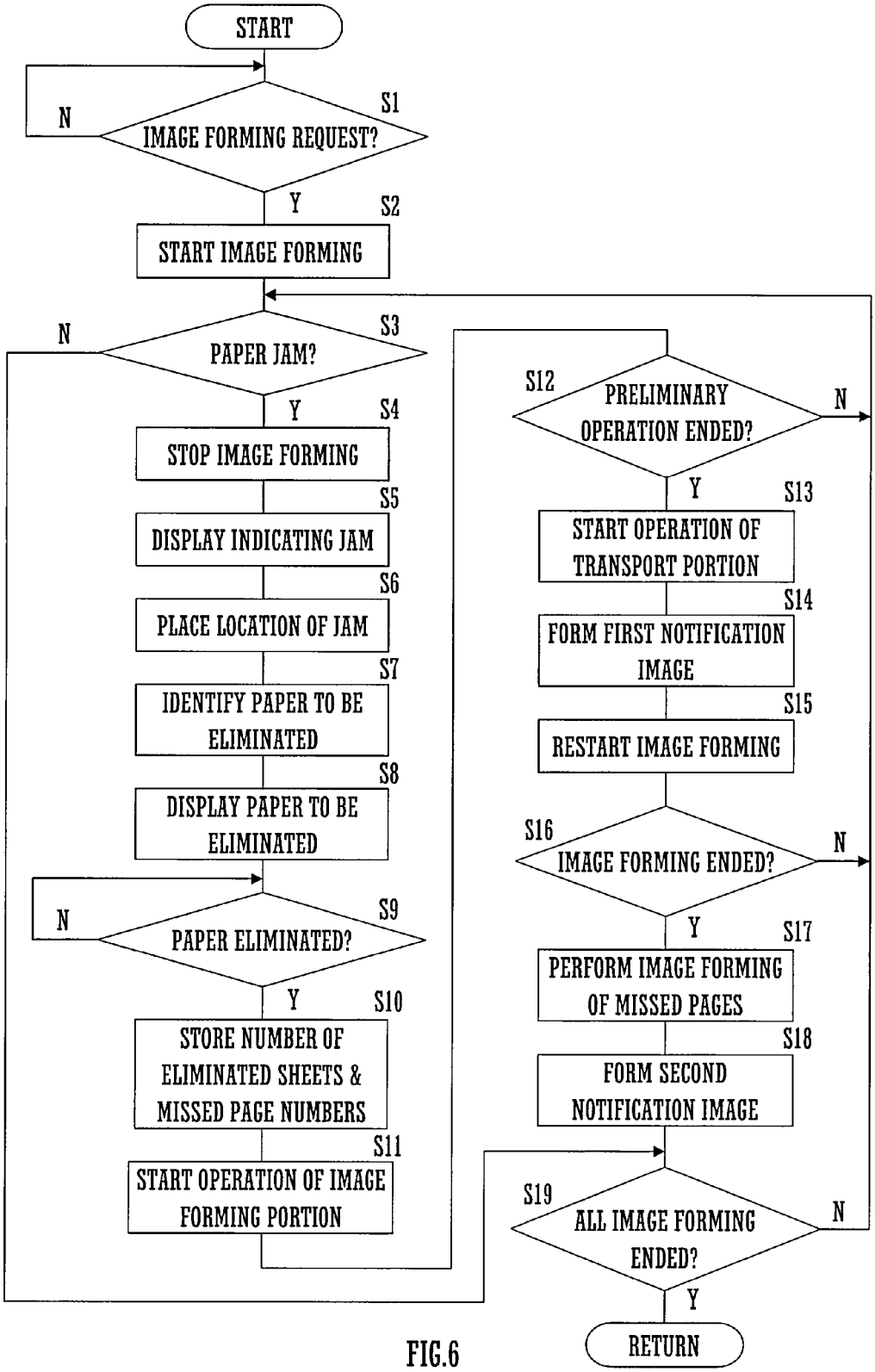
FIG. 6 is a flowchart showing a processing procedure during double-sided image forming in the control portion of the image forming apparatus.

FIG. 6 is a flowchart showing part of a processing procedure in the control portion 70 of the image forming apparatus 100 during image forming. When an image forming request is input as a result of an operation on the operation panel (not shown), the CPU 71 starts the image forming operation by operating the image reading unit 200 to read the images of the document, and operating the exposure apparatus 33, the motor driver 74, the solenoid driver 75 and the clutch driver 76 at a prescribed timing (S1, S2).

The CPU 71 checks for jams, based on the detection signals input from the sensor portion 82 during the image forming operation. The CPU 71 stops the image forming operation immediately if judged that a jam has occurred on the paper transport path 1 (S3, S4). As a result, the operation of the image reading unit 200 and the image forming portion 30, as well as the transportation of paper on the paper transport path 1 are stopped.

The CPU 71 displays that a jam has occurred on the display 78 of the operation panel (S5), and places the location of the jam (S6). Paper to be eliminated from the paper transport path 1 in the jam removal operation is predetermined according to the location of the jam on the paper transport path 1. For example, the relation between the location of jams and paper to be eliminated during double-sided image forming is determined as shown in FIG. 7, with the paper to be eliminated being jammed paper and paper present in the image forming portion 30.

Jammed paper is considered to have suffered twist, bends or similar damage, while it is highly unlikely that the continuity of the images will be maintained with paper present in the image forming portion 30 as a result of the image forming operation being interrupted.

The CPU 71 identifies the location of paper to be eliminated in the jam removal operation according to the result of placing the location of jam and the state of progress of the image forming operation (S7), and displays the result of this on the display 78 (S8).

For example, if a jam occurs at the placement location of any of the sensors 82A to 82J with paper being transported as shown in FIG. 3 during double-sided image forming, all of the sheets to be eliminated in FIG. 7 are displayed on the display 78 according to the location of the sensor that detected the jam. On the other hand, if a jam occurs immediately after the start of the image forming operation before the first sheet reaches the image forming portion 30, the sheets 602 and 603 are not displayed as paper to be eliminated since there is no paper in the image forming portion 30.

With this image forming apparatus 100, paper is not transported to the second transport path 12, but is inverted on the third transport path 13, during single-sided image forming.

Consequently, there is no paper at the locations of the sensors 82G to 82J during single-sided image forming, and jams also do not occur at these location. Paper is, however, transported to the fourth transport path 14 and the fifth transport path 15 during single-sided image forming. For this reason, sensors (not shown) are also placed on the fourth transport path 14 and the fifth transport path 15.

The CPU 71 waits in this state for the paper to be eliminated as a result of the jam removal operation (S9). Once the paper is eliminated, the CPU 71 stores the number of sheets eliminated and the page number of images (missed images) that were to be formed on the eliminated sheets (S10), and starts the operation of the image forming portion 30 (S11). At this point, the CPU 71 performs a preliminary operation that involves rotating the photosensitive drum 31, without operating the motor driver 74, the solenoid driver 75 and the clutch driver 76, and with paper on the paper transport path 1 in a stationary state.

Once a sufficient period of time has elapsed to eliminate the half-formed toner image and electrostatic latent image from the photosensitive drum 31, the CPU 71 operates the motor driver 74, the solenoid driver 75 and the clutch driver 76 to start the transportation of paper on the paper transport path 1 (S13).

The CPU 71 forms a first notification image 801 shown in FIG. 8 by way of example, on the first sheet transported to the image forming portion 30 after the jam removal operation. To this end, the CPU 71 reads the image data of the first notification image 801 prestored in the ROM 72, and supplies the read image data to the exposure apparatus 33. The CPU 71 then supplies the exposure apparatus 33 with image data related to the image forming request (image data read from the document) that has not yet been supplied to the exposure apparatus 33, in order from the first page, and restarts the image forming operation related to the image forming request interrupted by the jam (S15).

Figure 9:
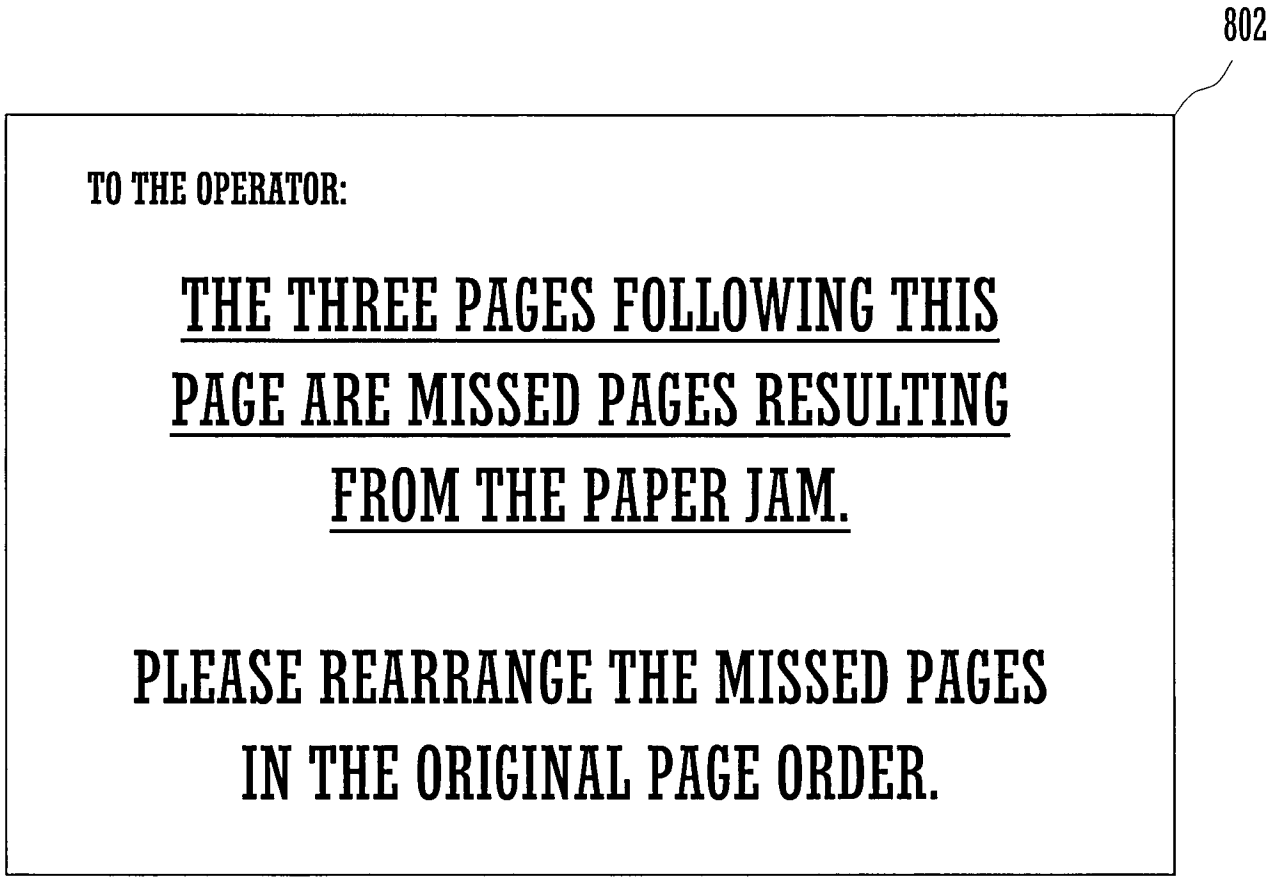
FIG. 9 shows an exemplary second notification image formed by the image forming apparatus.

Once image forming in relation to the last page of the image data related to the image forming request has ended, the CPU 71 performs the image forming operation on the missed images that were to be formed on the paper eliminated from the image forming portion 30 as a result of the jam removal operation (S16, S17). Once the image forming operation on the missed images has ended, the CPU 71 performs the image forming operation on a second notification image shown in FIG. 9 by way of example (S18). At this point, the CPU 71 reads the image data of the second notification image from the ROM 72, and supplies the image data combined with the eliminated number of pages stored at S10 to the exposure apparatus 33. On completion of all image forming operations, the CPU 71 returns to standby for an image forming request (S19).

After the end of a jam removal operation, the image forming operation is performed on the first notification image 801, before restarting the image forming operation in relation to image data related to an image forming request. As a result, it is possible to indicate that a jam has occurred during an image forming operation related to an image forming request, and to accurately show where the jam occurred in a stack of sheets collected in the discharge tray 38.

Note that the first notification image 801 can be readily distinguished from other sheets in the stack by being ejected image side up. Also, if the image forming apparatus 100 includes a shifter function, the sheet on which the first notification image is formed may be ejected at a different location to sheets having the images of the document related to the image forming request formed thereon. Further, it is also possible for the first notification image 801 to include an image of the page number of the image that was to be formed on jammed paper.

After the end of the image forming operation on the missed images, it is possible to indicate that paper having the missed images formed thereon is present in the stack of sheets collected in the discharge tray 38, and to accurately show the number of sheets on which the missed images are formed, by performing the image forming operation in relation to the second notification image 802.

Note that the second notification image 802 can be readily distinguished from other sheets in the stack by being ejected image side up. Also, if the image forming apparatus 100 includes a shifter function, the sheet on which the second notification image is formed may be ejected at a different location to sheets having the images of the document related to the image forming request formed thereon. Further, if the image forming apparatus 100 stores paper of a different size or color from the paper on which images related to an image forming request are formed, the second notification image 802 can be readily distinguished from other sheets in the stack by forming the second notification image 802 on paper of a different size or color.

The image forming operations on the first notification image 801 and the second notification image 802 are not essential, and either or both can also be omitted.

Finally, the description of the foregoing embodiment is in all respects illustrative and not limiting. The scope of the invention is indicated by the scope of the claims rather than by the foregoing embodiment. Further, all changes that come within the meaning and range of equivalency of the claims are intended to be embraced in the scope of the invention.

What is claimed is:

1. An image forming apparatus comprising:

a feeding portion that feeds plural sheets of prestored paper, one at a time;

an image forming portion that forms images on the sheets of paper fed from the feeding portion;

a discharge portion into which are ejected image-formed sheets on which images have been formed in the image forming portion;

a paper transport path that transports paper from the feeding portion to the discharge portion via the image forming portion;

a plurality of detecting members that detect a transport state of paper at a plurality of detection locations which include the feeding portion, between the feeding portion and the image forming portion, within the image forming portion, between the image forming portion and the discharge portion, and the discharge portion on the paper transport path; and a control portion that is configured, when a paper jam at any of the plurality of detection locations is detected based on the detection results of the plurality of detecting members, to display, on an indicator, information identifying as locations of papers to be eliminated from the paper transport path, the detection location at which the jam was detected, and the image forming portion when paper is detected by the detecting members as present in the image forming portion;

wherein the control portion is further configured to control the feeding operation of the feeding portion, the paper transport operation of the paper transport path and the image forming operation of the image forming portion, to include a storage portion for storing information identifying an image to be formed on paper stopped in the image forming portion if information identifying the image forming portion as the location at which paper to be eliminated from the paper transport path has stopped is displayed on the indicator, and to perform the image forming operation in relation to a missed pages notification image notifying that the image which was to be formed on eliminated paper will be formed on paper and in relation to the image identified by the information stored in the storage portion, once the image forming operation restarted after the jam.

2. The image forming apparatus according to claim 1, wherein the missed pages notification image includes an image notifying which sheets in a stack of image-formed sheets were removed as a result of a jam removal process.

3. The image forming apparatus according to claim 1, wherein the control portion is configured to form the image of the missed pages notification image on a different type of paper from the image-formed sheets.

* * * * *